US011560795B2

(12) United States Patent
Lee et al.

(10) Patent No.: US 11,560,795 B2
(45) Date of Patent: Jan. 24, 2023

(54) SCROLL COMPRESSOR WITH ASYMMETRICAL OLDHAM'S RING

(71) Applicant: LG Electronics Inc., Seoul (KR)

(72) Inventors: Kyungho Lee, Seoul (KR); Sangbaek Park, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 71 days.

(21) Appl. No.: 16/817,041

(22) Filed: Mar. 12, 2020

(65) Prior Publication Data

US 2020/0291779 A1 Sep. 17, 2020

(30) Foreign Application Priority Data

Mar. 12, 2019 (KR) ..... 10-2019-0027911

(51) Int. Cl.

| | |
|---|---|
| ***F01C 17/06*** | (2006.01) |
| ***F04C 18/02*** | (2006.01) |
| ***F04C 29/00*** | (2006.01) |
| ***F04C 27/00*** | (2006.01) |

(52) U.S. Cl.

CPC ..... *F01C 17/066* (2013.01); *F04C 18/0215* (2013.01); *F04C 27/008* (2013.01); *F04C 29/0057* (2013.01)

(58) Field of Classification Search

CPC .. F01C 17/066; F04C 18/0215; F04C 27/008; F04C 29/0057

See application file for complete search history.

(56) References Cited

U.S. PATENT DOCUMENTS

| | | | | |
|---|---|---|---|---|
| 5,141,421 | A | 8/1992 | Bush et al. | |
| 7,918,658 | B2 * | 4/2011 | Bush | F04C 18/0215 418/55.3 |
| 2019/0301458 | A1 * | 10/2019 | Yosuke | F01C 17/066 |

FOREIGN PATENT DOCUMENTS

| | | | |
|---|---|---|---|
| JP | 2018141443 | 9/2018 | |
| JP | 2018141444 | 9/2018 | |
| KR | 1020020063431 | 8/2002 | |
| WO | WO-2017203923 A1 * | 11/2017 | F01C 17/066 |

* cited by examiner

*Primary Examiner* — Mary Davis

(74) *Attorney, Agent, or Firm* — Fish & Richardson P.C.

(57) ABSTRACT

Disclosed is a scroll type compressor having an Oldham's ring having an asymmetrical structure with respect to a long or minor axis thereof.

21 Claims, 7 Drawing Sheets

--Prior Art--

SCROLL COMPRESSOR WITH ASYMMETRICAL OLDHAM'S RING

CROSS-REFERENCE TO RELATED APPLICATION

This application claims the benefit of Korean Patent Application No. 10-2019-0027911, filed on Mar. 12, 2019, which is hereby incorporated by reference as when fully set forth herein.

BACKGROUND

Field

The present disclosure relates to a compressor. More specifically, the present disclosure relates to a scroll type compressor in which a structure of an Oldham's ring that prevents spinning of an orbiting scroll is changed to reduce a weight thereof and to enlarge an oil collection channel.

Discussion of the Related Art

Generally, a compressor is an apparatus applied to a refrigeration cycle such as a refrigerator or an air conditioner, which compresses refrigerant to provide work necessary to generate heat exchange in the refrigeration cycle.

The compressors may be classified into a reciprocating type, a rotary type, and a scroll type based on a scheme for compressing the refrigerant. Among these, the scroll type compressor performs an orbiting motion by engaging an orbiting scroll with a fixed scroll fixed in an internal space of a sealed container to define a compression chamber between a fixed wrap of the fixed scroll and an orbiting wrap of the orbiting scroll.

Compared with other types of the compressor, the scroll type compressor may obtain a relatively high compression ratio because the refrigerant is continuously compressed through the scrolls engaged with each other, and may obtain a stable torque because suction, compression, and discharge of the refrigerant proceed smoothly. For this reason, the scroll type compressor is widely used for compressing the refrigerant in the air conditioner and the like.

Referring to US Patent Application Publication No. 2017/0067466, a conventional scroll type compressor includes a casing forming an outer shape of the compressor and having a discharging portion for discharging refrigerant, a compression assembly fixed to the casing to compress the refrigerant, and a driver fixed to the casing to drive the compression assembly, and the compression assembly and the driver are coupled to a rotation shaft that is coupled to the driver and rotates.

The compression assembly includes a fixed scroll fixed to the casing and having a fixed wrap, and an orbiting scroll including an orbiting wrap operated in a state of being engaged with the fixed wrap by the rotation shaft. Such the conventional scroll type compressor includes the rotation shaft eccentric, and the orbiting scroll fixed to the eccentric rotation shaft and rotating. Thus, the orbiting scroll orbits along the fixed scroll and compresses the refrigerant.

The conventional scroll type compressor further includes an Oldham's ring that prevent the orbiting scroll from spinning while being engaged with the fixed scroll.

FIGS. 1A and 1B show a structure of the Oldham's ring installed in a conventional scroll type compressor.

Referring to FIG. 1A, a compression assembly of the conventional scroll type compressor further includes a main frame 310 mounted on a fixed scroll to accommodate an orbiting scroll therein. The main frame 310 may include a main end plate 311 through which a rotation shaft passes, and a main side plate 312 protruding from an outer circumferential face of the main end plate 311 and seated on the fixed scroll.

The main end plate 311 may accommodate therein a main shaft receiving portion 318 through which the rotation shaft penetrates, and a backpressure seal 350 provided on an outer circumferential face of the main shaft receiving portion 318 to provide a back pressure to the orbiting scroll. In this connection, a discharge hole through which refrigerant discharges from the fixed scroll is laterally spaced from a center 318*a* of the rotation shaft, so a center 350*a* of the backpressure seal may be eccentrical relative to the main shaft receiving portion 318.

The Oldham's ring 700 may be constructed to be received in the main end plate 312.

The Oldham's ring 700 may include a ring body 710 provided to receive the backpressure seal 350 and a key 720 inserted from the ring body 710 into the main frame or orbiting scroll. The key 720 may be constructed to protrude along each of a major axis and a minor axis of the ring body 710. For example, the key 720 protruding along the major axis of the ring body may be constructed to be inserted into a main key groove 312*a* recessed in the main end plate 311. The key 720 protruding along the minor axis of the ring body may be constructed to protrude toward the orbiting scroll 330.

In this connection, the main key grooves 312*a* may be arranged in a symmetrical manner with each other respect to the main shaft receiving portion 318. Accordingly, the Oldham's ring 700 may reciprocate along the main key grooves 312*a*.

Referring to FIG. 1B, the orbiting scroll 330 may include a seal groove 336 in which the backpressure seal is installed, and an orbiting shaft receiving portion 338 through which the rotation shaft passes. Further, the orbiting scroll 330 may include an orbiting key groove 335 into which the key 720 of the Oldham's ring is inserted. The orbiting key groove 335 may be spaced from the main key groove 312*a* at an 90 degrees angular spacing. The orbiting key grooves 335 may be in the same line with an extension line D between a center 318*a* of the main shaft receiving portion and a center 350*a* of the backpressure seal.

Thus, the Oldham's ring is constructed such that the key 720 reciprocates along the main key groove 312*a* and the orbiting key groove 335, and is prevented from rotating. As a result, the orbiting scroll may be prevented from spinning.

Referring back to FIG. 1A, in the conventional scroll type compressor, the major axis of the Oldham's ring 700 bisects the minor axis equally, and the minor axis thereof bisects the major axis equally. In other words, a distance L1 of the Oldham's ring 700 between one of the keys 720 inserted into the main key grooves and a center of an extension line of a line between the keys 720 inserted into the orbiting scroll is equal to a distance L1 of the Oldham's ring 700 between the other of the keys 720 inserted into the main key grooves and the center of an extension line of a line between the keys 720 inserted into the orbiting scroll.

Further, the main frame of the conventional scroll type compressor further includes a collision-prevention groove 312*a* so that the key 720 inserted into the main key groove and the main side plate 312 may be prevented from colliding with each other. As a result, an inner peripheral surface of the main side plate 312 is not continuous due to the collision-prevention groove 312*a*, thereby reducing the compression efficiency in compressing the refrigerant. Further, due to the collision-prevention groove 312*a*, a pressure gradient occurs inside the main frame, thus causing noise or vibration.

Further, in the conventional scroll type compressor, an oil collection channel 301*a* defined in an outer circumferential face of the main frame to collect oil separated from the refrigerant should be constructed to be spaced apart from the main key groove and the collision-prevention groove 312*a*. In this connection, the main side plate has a plurality of main holes 317 defined therein through which the refrigerant flows, so that an area of the collection channel 301*a* should be reduced. As a result, there was a problem that collection efficiency of the oil is lowered.

Further, the conventional scroll type compressor has a problem that the Oldham's ring 700 has a symmetrical structure with respect to a center thereof and occupies a large area and has a relatively large weight so that a load applied to the driver increases and noise increases.

Further, reducing a thickness or changing a material of the Oldham's ring 700 caused a decrease in strength thereof such that reliability of the Oldham's ring could not be guaranteed. Thus, there was a limitation that the Oldham's ring 700 having a structure with a relatively large area should be employed.

SUMMARY

A purpose of the present disclosure is to provide a compressor having an Oldham's ring having an asymmetrical structure along a long or minor axis thereof.

A purpose of the present disclosure is to provide a compressor in which an area occupied by the Oldham's ring may be reduced while maintaining a thickness of the Oldham's ring.

A purpose of the present disclosure is to provide a compressor in which an inner face of the main frame housing the Oldham's ring may be prevented from being depressed or protruding.

A purpose of the present disclosure is to provide a compressor in which an area of an oil collection channel defined in a main frame may be increased by reducing an area occupied by the Oldham's ring.

A purpose of the present disclosure is to provide a compressor in which a weight of an Oldham's ring may be reduced by reducing a total area thereof while maintaining a thickness of the Oldham's ring.

A purpose of the present disclosure is to provide a compressor in which grooves in which an Oldham's ring is coupled to a main scroll are defined at a line inclined relative to a line extending between a backpressure seal and a rotation shaft, thereby to secure a moving space of the Oldham's ring to keep an inner circumferential face of the main scroll to be continuously circular.

Purposes of the present disclosure are not limited to the above-mentioned purpose. Other purposes and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

To accomplish the purposes above and other purposes, particular embodiments described herein include a compressor that includes a casing, a driver, and a compression assembly. The driver may be coupled to an inner surface of the casing and configured to rotate a rotation shaft. The compression assembly may be engaged with the rotation shaft and configured to compress a refrigerant. The compression assembly may include a fixed scroll, an orbiting scroll, a main frame, and a ring. The fixed scroll may be coupled to the inner surface of the casing. The orbiting scroll may be connected to the rotation shaft and configured to orbit relative to the fixed scroll. The main frame may be connected to the fixed scroll and at least partially receiving the orbiting scroll, the main frame supporting the rotation shaft. The ring may be engaged with the orbiting scroll and the main frame to block spinning of the orbiting scroll. The ring may be asymmetrical with respect to at least one of a radial direction of the ring, a minor axis of the ring, or a major axis of the ring.

In some implementations, the system can optionally include one or more of the following features. The ring may be an Oldham's ring. The ring may be asymmetrical with respect to the minor axis of the ring. For example, the ring may include a ring body, a plurality of scroll keys, and a plurality of frame keys. The ring body may be disposed between the orbiting scroll and the main frame. The rotation shaft may extend through the ring body. The plurality of scroll keys may protrude from the ring body in a direction along the minor axis and be inserted into the orbiting scroll. The plurality of frame keys may protrude from the ring body in a direction along the major axis and be inserted into the main frame. The ring body may be asymmetrical such that a distance of one of the plurality of scroll keys and one of the plurality of frame keys is different from a distance between the one of the plurality of scroll keys and another frame key of the plurality of frame keys. In other examples, the ring may include a ring body, a plurality of scroll keys, and a plurality of frame keys. The ring body may be disposed between the orbiting scroll and the main frame. The rotation shaft may extend through the ring body. The plurality of scroll keys may protrude from the ring body in a direction along the minor axis and be inserted into the orbiting scroll. The plurality of frame keys may protrude from the ring body in a direction along the major axis and be inserted into the main frame. The ring body may be asymmetrical such that a shortest distance between one of the plurality of frame keys and a line extending through the plurality of scroll keys is different from a shortest distance between another of the plurality of frame keys and the line extending through the plurality of scroll keys. In yet other examples, the fixed scroll may have a discharge hole that is spaced apart from the rotation shaft and configured to discharge the refrigerant. The ring may include a ring body, a plurality of scroll keys, and a plurality of frame keys. The ring body may be disposed between the orbiting scroll and the main frame. The rotation shaft may extend through the ring body. The plurality of scroll keys may protrude from the ring body in a direction along the minor axis and be inserted into the orbiting scroll. The plurality of frame keys may protrude from the ring body in a direction along the major axis and be inserted into the main frame. The ring body may be asymmetrical such that one of the plurality of frame keys spaced from a line extending through the plurality of scroll keys by a larger spacing than the other frame keys is closer to the discharge hole.

Particular embodiments described herein include a compressor that may include a casing, a driver, and a compression assembly. The driver may be coupled to an inner surface of the casing and configured to rotate a rotation shaft. The compression assembly may be engaged with the rotation shaft and configured to compress a refrigerant. The compression assembly may include a fixed scroll, an orbiting scroll, a main frame, a ring, and a backpressure seal. The fixed scroll may include a discharge hole that is spaced apart from the rotation shaft. The orbiting scroll may be connected to the rotation shaft and configured to orbit relative to the fixed scroll. The main frame may be connected to the fixed scroll and at least partially receiving the orbiting scroll. The main frame may support the rotation shaft. The ring may be engaged with the orbiting scroll and the main frame to block spinning of the orbiting scroll. The ring may have a major axis and a minor axis. The backpressure seal may be seated on the orbiting scroll within the ring. The backpressure seal may be positioned eccentrically relative to the rotation shaft to apply a back pressure toward the discharge hole. Of both ends corresponding to the long axis of the ring, one end of the ring spaced apart from the back pressure seal may be provided closer to the minor axis of the ring than the other end of the ring.

In some implementations, the system can optionally include one or more of the following features. The ring may be an Oldham's ring. The ring may include a ring body having the major axis and the minor axis. The major axis may be a line extending between a center of the backpressure seal and a center of the rotation shaft. An end of the major axis of the ring body that is spaced farther from the eccentric backpressure seal than an opposite end of the major axis of the ring body is closer to the minor axis than the opposite end of the major axis of the ring body. The end of the major axis of the ring body may be provided closer to the minor axis of the ring body than the opposite end of the major axis of the ring body. The closer distance corresponds to a distance from which the center of the backpressure seal is spaced apart from the center of the rotation shaft. The ring may include a plurality of frame keys protruding from the ring body in a direction along the major axis and inserted into the main frame. The ring body may be constructed such that one of the plurality of frame keys is closer to the backpressure seal than another of the plurality of frame keys. The plurality of frame keys may include a first frame key and a second frame key. The first frame key may be spaced farther from the center of the backpressure seal than the second frame key. The ring body may be constructed such that a first distance between the first frame key and the minor axis is shorter than a second distance between the second frame key and the minor axis, thereby reducing a distance between the first frame key and the second frame key. A length by which the first distance is shorter than the second distance is equal to a distance between the center of the backpressure seal and the center of the rotation shaft. The minor axis may be perpendicular to the major axis. A distance between opposite ends in the minor axis of the ring body may be equal to a diameter of the backpressure seal.

Particular embodiments described herein include a compressor that may include a casing, a driver, and a compression assembly. The driver may be coupled to an inner surface of the casing and configured to rotate a rotation shaft. The compression assembly may be engaged with the rotation shaft and configured to compress a refrigerant. The compression assembly may include a fixed scroll, an orbiting scroll, a main frame, and a ring. The fixed scroll may be coupled to the inner surface of the casing. The orbiting scroll may be connected to the rotation shaft and configured to orbit relative to the fixed scroll. The main frame may be connected to the fixed scroll and at least partially receive the orbiting scroll, the main frame supporting the rotation shaft. The ring may be engaged with the orbiting scroll and the main frame to reduce spinning of the orbiting scroll. The ring may include a ring body and a plurality of frame keys. The ring body may have a major axis and a minor axis that is different in length from the major axis. The plurality of frame keys may protrude from the ring body in a direction along the major axis and be inserted into the main frame. The main frame may include a main end plate, a main side plate, and a plurality of main key grooves. The main end plate is configured so that the rotation shaft extends through the main end plate. The main side plate may extend along a circumference of the main end plate and be configured to receive the ring body. The plurality of main key grooves may be defined in the main end plate. The plurality of frame keys of the ring may be inserted into, and movable linearly along, the plurality of main key grooves, respectively. The plurality of main key grooves may be arranged asymmetrically about the rotation shaft.

In some implementations, the system can optionally include one or more of the following features. The ring may be an Oldham's ring. The main frame may include a collection channel configured to receive an oil. The channel may be recessed at a face of the main side plate. At least one of the plurality of main key grooves may overlap the collection channel in a radial direction of the rotation shaft. At least one of the plurality of main key grooves may be spaced apart from a peripheral surface of the main side plate toward the rotation shaft by a larger distance than another of the plurality of main key grooves.

Particular embodiments described herein include a compressor that may include a casing, a driver, and a compression assembly. The driver may be coupled to an inner surface of the casing, and configured to rotate a rotation shaft. The compression assembly may be engaged with the rotation shaft and configured to compress a refrigerant. The compression assembly may include a fixed scroll, an orbiting scroll, a main frame, an Oldham's ring, and a backpressure seal. The fixed scroll may include a discharge hole. The orbiting scroll may be connected to the rotation shaft and configured to orbit relative to the fixed scroll. The main frame may be connected to the fixed scroll and at least partially receive the orbiting scroll. The main frame may support the rotation shaft. The Oldham's ring may be engaged with the orbiting scroll and the main frame to reduce spinning of the orbiting scroll. The backpressure seal may be seated on the orbiting scroll within the Oldham's ring. The backpressure seal may be positioned eccentrically relative to the rotation shaft to apply a back pressure toward the discharge hole. The Oldham's ring may include a ring body and a plurality of frame keys. The ring body may have a major axis and a minor axis that is different in length from the major axis. The plurality of frame keys may protrude from the ring body in a direction along the major axis and inserted into the main frame. The plurality of frame keys may be arranged to be inclined relative to a line extending between a center of the backpressure seal and a center of the rotation shaft.

In some implementations, the system can optionally include one or more of the following features. The main frame may include a main end plate, a main side plate, and a plurality of main key grooves. The main end plate is configured such that the rotation shaft extends through the main end plate. The main side plate may extend along a circumference of the main end plate and be configured to receive the ring body. The plurality of main key grooves may be defined in the main end plate. The plurality of frame keys of the Oldham's ring may be inserted into, and movable linearly along, the main key grooves respectively. The main side plate may have a circular shape configured to prevent the plurality of frame keys from colliding with the main side plate so that the main side plate is free of a collision-prevention groove.

In order to achieve the purposes, the present disclosure provides an Oldham's ring having an asymmetrical structure adapted to an eccentric position of a backpressure seal. As a result, at least one of the Oldham's ring and the main frame may be reduced in weight, and an area of an oil collection channel may be increased.

In a compressor in accordance with the present disclosure, one end of the Oldham's ring may be shortened to achieve the asymmetrical structure. As a result, the weight may be reduced as much as one end of the Oldham's ring is shortened When the Oldham's ring is constructed in an oval or track shape, the major axis may be shorter than the minor axis. As a result, the effect of weight reduction may be maximized.

Furthermore, the major axis of the Oldham's ring may be shortened by a distance between the center of the backpressure seal and the center of the rotation shaft.

Further, the size of the frame key protruding from the major axis portion of the Oldham's ring and coupled to the main frame may be shortened in the major axis direction. As the Oldham's ring is shortened, the size of the oil collection channel defined in the main frame may increase correspondingly.

Further, in the compressor according to an embodiment of the present disclosure, the inner circumferential surface of the main frame may be maintained to be continuously circular, thereby to increase the compression efficiency. This is because key grooves of the main frame are asymmetrically arranged due to the reduced length of the Oldham's ring, so that the main frame may be free of a collision-prevention groove to prevent collision thereof with the key of the Oldham's ring.

The features of the present disclosure may be applied to a general scroll type compressor as well as to a shaft-through scroll type compressor.

The present disclosure provides a shaft-through compressor having an Oldham's ring having an asymmetrical structure rather than an symmetrical structure.

The present disclosure may provide a mainframe collection channel enlarged structure due to the Oldham's ring size reduction.

Further, in accordance with the present disclosure, the Oldham's ring may be constructed so that a distance between both ends of the minor axis thereof may be reduced to a diameter of the backpressure seal. Further, the Oldham's ring size reduction may allow the inner circumference face of the main frame to be continuously circular. Further, it may be possible to reduce the weight of the main frame in a corresponding manner to a length by which the Oldham's ring is shortened.

Further, in accordance with the present disclosure, the Oldham's ring may be constructed such that the major axis of the Oldham's ring is oriented in an inclined manner to the direction in which the backpressure seal is eccentric.

The features of the above-described implantations may be combined with other embodiments as long as they are not contradictory or exclusive to each other.

The present disclosure has an effect of providing a compressor having an Oldham's ring having an asymmetrical structure along a long or minor axis thereof.

The present disclosure has an effect of providing a compressor in which an area occupied by the Oldham's ring may be reduced while maintaining a thickness of the Oldham's ring.

The present disclosure has an effect of providing a compressor in which an inner face of the main frame housing the Oldham's ring may be prevented from being depressed or protruding.

The present disclosure has an effect of providing a compressor in which an area of an oil collection channel defined in a main frame may be increased by reducing an area occupied by the Oldham's ring.

The present disclosure has an effect of providing a compressor in which a weight of an Oldham's ring may be reduced by reducing a total area thereof while maintaining a thickness of the Oldham's ring.

The present disclosure has an effect of providing a compressor in which grooves in which an Oldham's ring is coupled to a main scroll are defined at a line inclined relative to a line extending between a backpressure seal and a rotation shaft, thereby to secure a moving space of the Oldham's ring to keep an inner circumferential face of the main scroll to be continuously circular.

Effects of the present disclosure are as follows but are limited thereto.

DETAILED DESCRIPTIONS

Figures 1A, 1B:
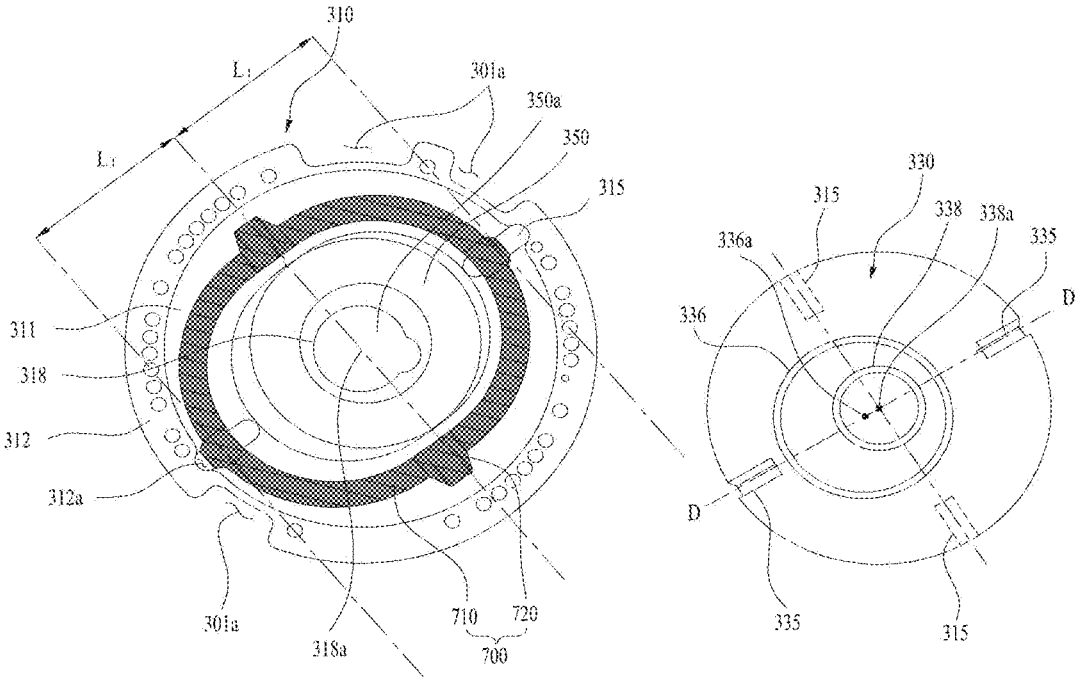
FIGS. 1A and 1B show a structure of the Oldham's ring of the conventional compressor.

For simplicity and clarity of illustration, elements in the figures are not necessarily drawn to scale. The same reference numbers in different figures denote the same or similar elements, and as such perform similar functionality. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or greater of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers. It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
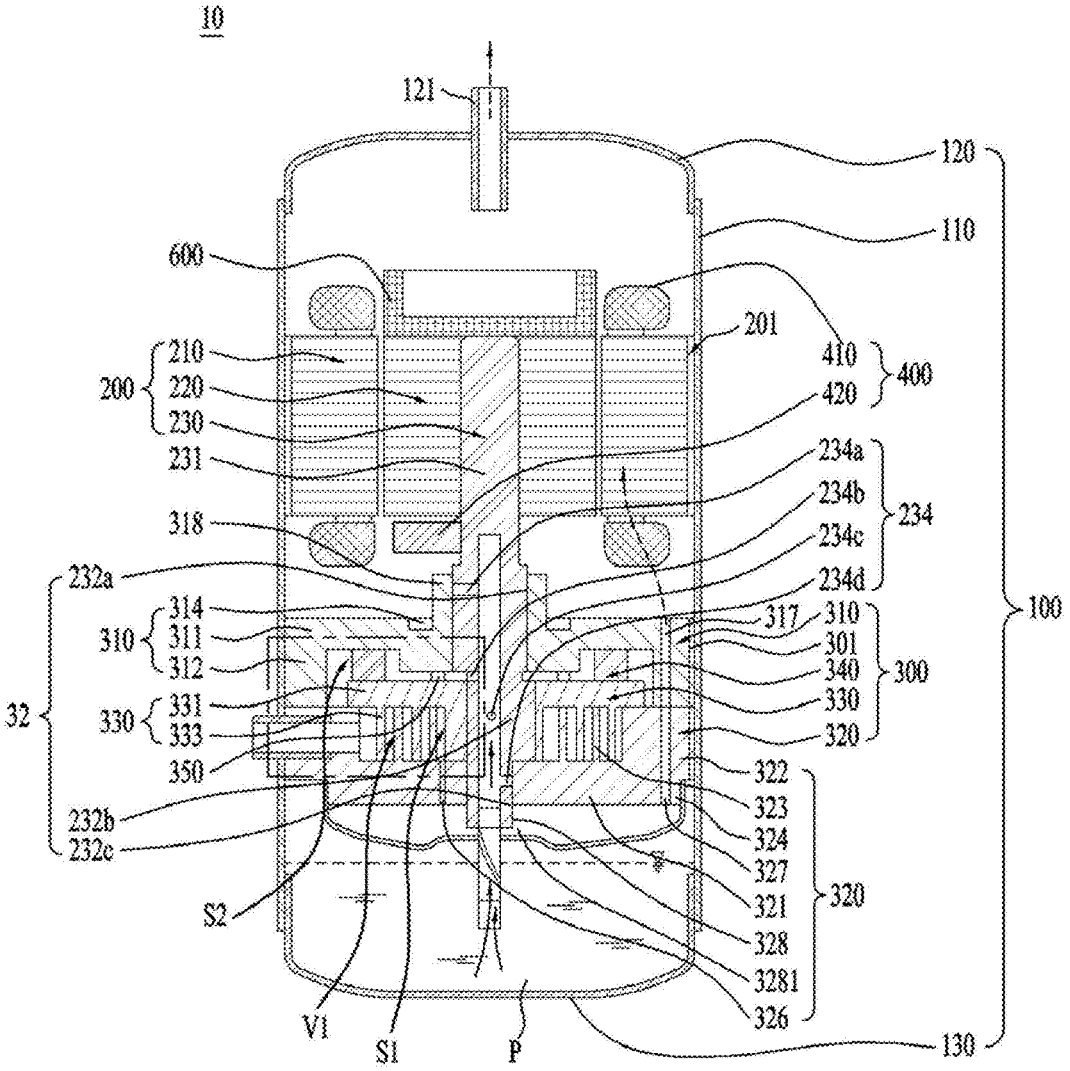
FIG. 2 illustrates a structure of a compressor according to one embodiment of the present disclosure.

Referring to FIG. 2, a scroll type compressor 10 according to an embodiment of the present disclosure may include a casing 100 having therein a space in which fluid is stored or flows, a driver 200 coupled to an inner circumferential face of the casing 100 to rotate a rotation shaft 230, and a compression assembly 300 coupled to the rotation shaft 230 inside the casing and compressing the fluid.

Specifically, the casing 100 may include a discharging portion 121 through which refrigerant is discharged at one side. The casing 100 may include a receiving shell 110 provided in a cylindrical shape to receive the driver 200 and the compression assembly 300 therein, a discharge shell 120 coupled to one end of the receiving shell 110 and having the discharging portion 121, and a sealing shell 130 coupled to the other end of the receiving shell 110 to seal the receiving shell 110.

The driver 200 includes a stator 210 for generating a rotating magnetic field, and a rotor 220 disposed to rotate by the rotating magnetic field. The rotation shaft 230 may be coupled to the rotor 220 to be rotated together with the rotor 220.

The stator 210 has a plurality of slots defined in an inner circumferential face thereof along a circumferential direction and a coil is wound around the plurality of slots. Further, the stator 210 may be fixed to an inner circumferential face of the receiving shell 110. A permanent magnet may be coupled to the rotor 220, and the rotor 220 may be rotatably coupled within the stator 210 to generate rotational power. The rotation shaft 230 may be pressed into and coupled to a center of the rotor 220.

The compression assembly 300 may include a fixed scroll 320 coupled to the receiving shell 110 and disposed in a direction away from the discharging portion 121 with respect to the driver 200, an orbiting scroll 330 coupled to the rotation shaft 230 and engaged with the fixed scroll 320 to define a compression chamber, and a main frame 310 accommodating the orbiting scroll 330 therein and seated on the fixed scroll 320 to form an outer shape of the compression assembly 300.

As a result, the lower scroll type compressor 10 has the driver 200 disposed between the discharging portion 120 and the compression assembly 300. In other words, the driver 200 may be disposed at one side of the discharging portion 120, and the compression assembly 300 may be disposed in a direction away from the discharging portion 121 with respect to the driver 200. For example, when the discharging portion 121 is disposed on the casing 100, the compression assembly 300 may be disposed below the driver 200, and the driver 200 may be disposed between the discharging portion 120 and the compression assembly 300.

Thus, when oil is stored in an oil storage space p of the casing 100, the oil may be supplied directly to the compression assembly 300 without passing through the driver 200. In addition, since the rotation shaft 230 is coupled to and supported by the compression assembly 300, a lower frame for rotatably supporting the rotation shaft may be omitted.

In one example, the lower scroll type compressor 10 of the present disclosure may be provided such that the rotation shaft 230 penetrates not only the orbiting scroll 330 but also the fixed scroll 320 to be in face contact with both the orbiting scroll 330 and the fixed scroll 320.

As a result, an inflow force generated when the fluid such as the refrigerant is flowed into the compression assembly 300, a gas force generated when the refrigerant is compressed in the compression assembly 300, and a reaction force for supporting the same may be directly exerted on the rotation shaft 230. Accordingly, the inflow force, the gas force, and the reaction force may be exerted to a point of application of the rotation shaft 230. As a result, since an upsetting moment does not act on the orbiting scroll 320 coupled to the rotation shaft 230, tilting or upsetting of the orbiting scroll may be blocked. In other words, tilting in an axial direction of the tilting may be attenuated or prevented, and the upsetting moment of the orbiting scroll 330 may also be attenuated or suppressed. As a result, noise and vibration generated in the lower scroll type compressor 10 may be blocked.

In addition, the fixed scroll 320 is in face contact with and supports the rotation shaft 230, so that durability of the rotation shaft 230 may be reinforced even when the inflow force and the gas force act on the rotation shaft 230.

In addition, a backpressure generated while the refrigerant is discharged to outside is also partially absorbed or supported by the rotation shaft 230, so that a force (normal force) in which the orbiting scroll 330 and the fixed scroll 320 become excessively close to each other in the axial direction may be reduced. As a result, a friction force between the orbiting scroll 330 and the fixed scroll 320 may be greatly reduced.

As a result, the compressor 10 attenuates the tilting in the axial direction and the upsetting moment of the orbiting scroll 330 inside the compression assembly 300 and reduces the frictional force of the orbiting scroll, thereby increasing an efficiency and a reliability of the compression assembly 300.

In one example, the main frame 310 of the compression assembly 300 may include a main end plate 311 provided at one side of the driver 200 or at a lower portion of the driver 200, a main side plate 312 extending in a direction farther away from the driver 200 from an inner circumferential face of the main end plate 311 and seated on the fixed scroll 330, and a main shaft receiving portion 318 extending from the main end plate 311 to rotatably support the rotation shaft 230.

A main hole 317 for guiding the refrigerant discharged from the fixed scroll 320 to the discharging portion 121 may be further defined in the main end plate 311 or the main side plate 312.

The main end plate 311 may further include an oil pocket 314 that is engraved in an outer face of the main shaft receiving portion 318. The oil pocket 314 may be defined in an annular shape, and may be defined to be eccentric to the main shaft receiving portion 318. When the oil stored in the sealing shell 130 is transferred through the rotation shaft 230 or the like, the oil pocket 314 may be defined such that the oil is supplied to a portion where the fixed scroll 320 and the orbiting scroll 330 are engaged with each other.

The fixed scroll 320 may include a fixed end plate 321 coupled to the receiving shell 110 in a direction away from the driver 200 with respect to the main end plate 311 to form the other face of the compression assembly 300, a fixed side plate 322 extending from the fixed end plate 321 to the discharging portion 121 to be in contact with the main side plate 312, and a fixed wrap 323 disposed on an inner circumferential face of the fixed side plate 322 to define the compression chamber in which the refrigerant is compressed.

In one example, the fixed scroll 320 may include a fixed through-hole 328 defined to penetrate the rotation shaft 230, and a fixed shaft receiving portion 3281 extending from the fixed through-hole 328 such that the rotation shaft is rotatably supported. The fixed shaft receiving portion 3331 may be disposed at a center of the fixed end plate 321.

A thickness of the fixed end plate 321 may be equal to a thickness of the fixed shaft receiving portion 3381. In this case, the fixed shaft receiving portion 3281 may be inserted into the fixed through-hole 328 instead of protruding from the fixed end plate 321.

The fixed side plate 322 may include an inflow hole 325 defined therein for flowing the refrigerant into the fixed wrap 323, and the fixed end plate 321 may include discharge hole 326 defined therein through which the refrigerant is discharged. The discharge hole 326 may be defined in a center direction of the fixed wrap 323, or may be spaced apart from the fixed shaft receiving portion 3281 to avoid interference with the fixed shaft receiving portion 3281, or the discharge hole 326 may include a plurality of discharge holes (e.g., 326*a* and 326*b* in FIG. 3B).

The orbiting scroll 330 may include an orbiting end plate 331 disposed between the main frame 310 and the fixed scroll 320, and an orbiting wrap 333 disposed below the orbiting end plate to define the compression chamber together with the fixed wrap 323 in the orbiting end plate.

The orbiting scroll 330 may further include an orbiting shaft receiving portion 338 defined through the orbiting end plate 331 to rotatably couple the rotation shaft 230.

The rotation shaft 230 may be disposed such that a portion thereof coupled to the orbiting shaft receiving portion 338 is eccentric. Thus, when the rotation shaft 230 is rotated, the orbiting scroll 330 moves in a state of being engaged with the fixed wrap 323 of the fixed scroll 320 to compress the refrigerant.

Specifically, the rotation shaft 230 may include a main shaft 231 coupled to the driver 200 and rotating, and a bearing portion 232 connected to the main shaft 231 and rotatably coupled to the compression assembly 300. The bearing portion 232 may be included as a member separate from the main shaft 231, and may accommodate the main shaft 231 therein, or may be integrated with the main shaft 231.

The bearing portion 232 may include a main bearing portion 232*c* inserted into the main shaft receiving portion 318 of the main frame 310 and rotatably supported, a fixed bearing portion 232*a* inserted into the fixed shaft receiving portion 3281 of the fixed scroll 320 and rotatably supported, and an eccentric shaft 232*b* disposed between the main bearing portion 232*c* and the fixed bearing portion 232*a*, and inserted into the orbiting shaft receiving portion 338 of the orbiting scroll 330 and rotatably supported.

In this connection, the main bearing portion 232*c* and the fixed bearing portion 232*a* may be coaxial to have the same axis center, and the eccentric shaft 232*b* may be formed such that a center of gravity thereof is radially eccentric with respect to the main bearing portion 232*c* or the fixed bearing portion 232*a*. In addition, the eccentric shaft 232*b* may have an outer diameter greater than an outer diameter of the main bearing portion 232*c* or an outer diameter of the fixed bearing portion 232*a*. As such, the eccentric shaft 232*b* may provide a force to compress the refrigerant while orbiting the orbiting scroll 330 when the bearing portion 232 rotates, and the orbiting scroll 330 may be disposed to regularly orbit the fixed scroll 320 by the eccentric shaft 232*b*.

However, in order to prevent the orbiting scroll 320 from rotating, the compressor 10 of the present disclosure may further include an Oldham's ring 340 coupled to an upper portion of the orbiting scroll 320. The Oldham's ring 340 may be disposed between the orbiting scroll 330 and the main frame 310 to be in contact with both the orbiting scroll 330 and the main frame 310. The Oldham's ring 340 may be disposed to linearly move in four directions of front, rear, left, and right directions to prevent the rotation of the orbiting scroll 320.

In one example, the rotation shaft 230 may be disposed to completely pass through the fixed scroll 320 to protrude out of the compression assembly 300. As a result, the rotation shaft 230 may be in direct contact with outside of the compression assembly 300 and the oil stored in the sealing shell 130. The rotation shaft 230 may supply the oil into the compression assembly 300 while rotating.

The oil may be supplied to the compression assembly 300 through the rotation shaft 230. An oil supply channel 234 for supplying the oil to an outer circumferential face of the main bearing portion 232*c*, an outer circumferential face of the fixed bearing portion 232*a*, and an outer circumferential face of the eccentric shaft 232*b* may be formed at or inside the rotation shaft 230.

In addition, a plurality of oil supply holes 234*a*, 234*b*, 234*c*, and 234*d* may be defined in the oil supply channel 234. Specifically, the oil supply hole may include a first oil supply hole 234*a*, a second oil supply hole 234*b*, a third oil supply hole 234*c*, and a fourth oil supply hole 234*d*. First, the first oil supply hole 234*a* may be defined to penetrate through the outer circumferential face of the main bearing portion 232*c*.

The first oil supply hole 234*a* may be defined to penetrate into the outer circumferential face of the main bearing portion 232*c* in the oil supply channel 234. In addition, the first oil supply hole 234*a* may be defined to, for example, penetrate an upper portion of the outer circumferential face of the main bearing portion 232*c*, but is not limited thereto. That is, the first oil supply hole 234*a* may be defined to penetrate a lower portion of the outer circumferential face of the main bearing portion 232*c*. For reference, unlike as shown in the drawing, the first oil supply hole 234*a* may include a plurality of holes. In addition, when the first oil supply hole 234*a* includes the plurality of holes, the plurality of holes may be defined only in the upper portion or only in the lower portion of the outer circumferential face of the main bearing portion 232*c*, or may be defined in both the upper and lower portions of the outer circumferential face of the main bearing portion 232*c*.

In addition, the rotation shaft 230 may include an oil feeder 233 disposed to pass through a muffler 500 to be described later to be in contact with the stored oil of the casing 100. The oil feeder 233 may include an extension shaft 233*a* passing through the muffler 500 and in contact with the oil, and a spiral groove 233*b* spirally defined in an outer circumferential face of the extension shaft 233*a* and in communication with the supply channel 234.

Thus, when the rotation shaft 230 is rotated, due to the spiral groove 233*b*, a viscosity of the oil, and a pressure difference between a high pressure region S1 and an intermediate pressure region V1 inside the compression assembly 300, the oil rises through the oil feeder 233 and the supply channel 234 and is discharged into the plurality of oil supply holes. The oil discharged through the plurality of oil supply holes 234*a*, 234*b*, 234*c*, and 234*d* not only maintains an airtight state by forming an oil film between the fixed scroll 250 and the orbiting scroll 240, but also absorbs frictional heat generated at friction portions between the components of the compression assembly 300 and discharge the heat.

The oil guided along the rotation shaft 230 and supplied through the first oil supply hole 234*a* may lubricate the main frame 310 and the rotation shaft 230. In addition, the oil may be discharged through the second oil supply hole 234*b* and supplied to a top face of the orbiting scroll 240, and the oil supplied to the top face of the orbiting scroll 240 may be guided to the intermediate pressure region through the pocket groove 314. For reference, the oil discharged not only through the second oil supply hole 234*b* but also through the first oil supply hole 234*a* or the third oil supply hole 234*d* may be supplied to the pocket groove 314.

In one example, the oil guided along the rotation shaft 230 may be supplied to the Oldham's ring 340 and the fixed side plate 322 of the fixed scroll 320 installed between the orbiting scroll 240 and the main frame 310. Thus, wear of the fixed side plate 322 of the fixed scroll 320 and the Oldham's ring 340 may be reduced. In addition, the oil supplied to the third oil supply hole 234*c* is supplied to the compression chamber to not only reduce wear due to friction between the orbiting scroll 330 and the fixed scroll 320, but also form the oil film and discharge the heat, thereby improving a compression efficiency.

Although a centrifugal oil supply structure in which the lower scroll type compressor 10 uses the rotation of the rotation shaft 230 to supply the oil to the bearing has been described, the centrifugal oil supply structure is merely an example. Further, a differential pressure supply structure for supplying oil using a pressure difference inside the compression assembly 300 and a forced oil supply structure for supplying oil through a trochoid pump, and the like may also be applied.

In one example, the compressed refrigerant is discharged to the discharge hole 326 along a space defined by the fixed wrap 323 and the orbiting wrap 333. The discharge hole 326 may be more advantageously disposed toward the discharging portion 121. This is because the refrigerant discharged from the discharge hole 326 is most advantageously delivered to the discharging portion 121 without a large change in a flow direction.

However, because of structural characteristics that the compression assembly 300 is provided in a direction away from the discharging portion 121 with respect to the driver 200, and that the fixed scroll 320 should be disposed at an outermost portion of the compression assembly 300, the discharge hole 326 is disposed to spray the refrigerant in a direction opposite to the discharging portion 121.

In other words, the discharge hole 326 is defined to spray the refrigerant in a direction away from the discharging portion 121 with respect to the fixed end plate 321. Therefore, when the refrigerant is sprayed into the discharge hole 326 as it is, the refrigerant may not be smoothly discharged to the discharging portion 121, and when the oil is stored in the sealing shell 130, the refrigerant may collide with the oil and be cooled or mixed.

In order to prevent this, the compressor 10 of the present disclosure may further include the muffler 500 coupled to an outermost portion of the fixed scroll 320 and providing a space for guiding the refrigerant to the discharging portion 121.

The muffler 500 may be disposed to seal one face disposed in a direction farther away from the discharging portion 121 of the fixed scroll 320 to guide the refrigerant discharged from the fixed scroll 320 to the discharging portion 121.

The muffler 500 may include a coupling body 520 coupled to the fixed scroll 320 and a receiving body 510 extending from the coupling body 520 to define sealed space therein. Thus, the refrigerant sprayed from the discharge hole 326 may be discharged to the discharging portion 121 by switching the flow direction along the sealed space defined by the muffler 500.

Further, since the fixed scroll 320 is coupled to the receiving shell 110, the refrigerant may be restricted from flowing to the discharging portion 121 by being interrupted by the fixed scroll 320. Therefore, the fixed scroll 320 may further include a bypass hole 327 defined therein allowing the refrigerant penetrated the fixed end plate 321 to pass through the fixed scroll 320. The bypass hole 327 may be disposed to be in communication with the main hole 317. Thus, the refrigerant may pass through the compression assembly 300, pass the driver 200, and be discharged to the discharging portion 121.

The more the refrigerant flows inward from an outer circumferential face of the fixed wrap 323, the higher the pressure compressing the refrigerant. Thus, an interior of the fixed wrap 323 and an interior of the orbiting wrap 333 maintain in a high pressure state. Accordingly, a discharge pressure is exerted to a rear face of the orbiting scroll as it is, and the backpressure is exerted toward the fixed scroll in the orbiting scroll, reactionally. The compressor 10 of the present disclosure may further include a backpressure seal 350 that concentrates the backpressure on a portion where the orbiting scroll 320 and the rotation shaft 230 are coupled to each other, thereby preventing leakage between the orbiting wrap 333 and the fixed wrap 323.

The backpressure seal 350 is disposed in a ring shape to maintain an inner circumferential face thereof at a high pressure, and separate an outer circumferential face thereof at an intermediate pressure lower than the high pressure. Therefore, the backpressure is concentrated on the inner circumferential face of the backpressure seal 350, so that the orbiting scroll 330 is in close contact with the fixed scroll 320.

In this connection, considering that the discharge hole 326 is defined to be spaced apart from the rotation shaft 230, the backpressure seal 350 may also be disposed such that a center thereof is biased toward the discharge hole 326.

In addition, due to the backpressure seal 350, the oil supplied from the first oil supply groove 234*a* may be supplied to the inner circumferential face of the backpressure seal 350. Therefore, the oil may lubricate a contact face between the main scroll and the orbiting scroll. Further, the oil supplied to the inner circumferential face of the backpressure seal 350 may generate a backpressure for pushing the orbiting scroll 330 to the fixed scroll 320 together with a portion of the refrigerant.

As such, the compression space of the fixed wrap 323 and the orbiting wrap 333 may be divided into the high pressure region S1 inside the backpressure seal 350 and the intermediate pressure region V1 outside the backpressure seal 350 on the basis of the backpressure seal 350. In one example, the high pressure region S1 and the intermediate pressure region V1 may be naturally divided because the pressure is increased in a process in which the refrigerant is inflowed and compressed. However, since the pressure change may occur critically due to a presence of the backpressure seal 350, the compression space may be divided by the backpressure seal 350.

In one example, the oil supplied to the compression assembly 300, or the oil stored in the oil storage space P of the casing 100 may flow toward an upper portion of the casing 100 together with the refrigerant as the refrigerant is discharged to the discharging portion 121. In this connection, because the oil is denser than the refrigerant, the oil may not be able to flow to the discharging portion 121 by a centrifugal force generated by the rotor 220, and may be attached to inner walls of the discharge shell 120 and the receiving shell 110. The lower scroll type compressor 10 may further include collection passages respectively on outer circumferential faces of the driver 200 and the compression assembly 300 to collect the oil attached to an inner wall of the casing 100 to the oil storage space of the casing 100 or the sealing shell 130.

The collection channel may include a driver collection channel 201 defined in an outer circumferential face of the driver 200, a compression assembly collection channel 301 defined in an outer circumferential face of the compression assembly 300, and a muffler collection channel 501 defined in an outer circumferential face of the muffler 500.

The driver collection channel 201 may be defined by recessing a portion of an outer circumferential face of the stator 210 is recessed, and the compression assembly collection channel 301 may be defined by recessing a portion of an outer circumferential face of the fixed scroll 320. In addition, the muffler collection channel 501 may be defined by recessing a portion of the outer circumferential face of the muffler. The driver collection channel 201, the compression assembly collection channel 301, and the muffler collection channel 501 may be defined in communication with each other to allow the oil to pass therethrough.

As described above, because the rotation shaft 230 has a center of gravity biased to one side due to the eccentric shaft 232*b*, during the rotation, an unbalanced eccentric moment occurs, causing an overall balance to be distorted. Accordingly, the lower scroll type compressor 10 of the present disclosure may further include a balancer 400 that may offset the eccentric moment that may occur due to the eccentric shaft 232*b*.

Because the compression assembly 300 is fixed to the casing 100, the balancer 400 is preferably coupled to the rotation shaft 230 itself or the rotor 220 disposed to rotate. Therefore, the balancer 400 may include a central balancer 410 disposed on a bottom of the rotor 220 or on a face f acing the compression assembly 300 to offset or reduce an eccentric load of the eccentric shaft 232*b*, and an outer balancer 420 coupled to a top of the rotor 220 or the other face facing the discharging portion 121 to offset an eccentric load or an eccentric moment of at least one of the eccentric shaft 232*b* and the outer balancer 420.

Because the central balancer 410 is disposed relatively close to the eccentric shaft 232*b*, the central balancer 410 may directly offset the eccentric load of the eccentric shaft 232*b*. Accordingly, the central balancer 410 is preferably disposed eccentrically in a direction opposite to the direction in which the eccentric shaft 232*b* is eccentric. As a result, even when the rotation shaft 230 rotates at a low speed or a high speed, because a distance away from the eccentric shaft 232*b* is close, the central balancer 410 may effectively offset an eccentric force or the eccentric load generated in the eccentric shaft 232*b* almost uniformly.

The outer balancer 420 may be disposed eccentrically in a direction opposite to the direction in which the eccentric shaft 232*b* is eccentric. However, the outer balancer 420 may be eccentrically disposed in a direction corresponding to the eccentric shaft 232*b* to partially offset the eccentric load generated by the central balancer 410.

As a result, the central balancer 410 and the outer balancer 420 may offset the eccentric moment generated by the eccentric shaft 232*b* to assist the rotation shaft 230 to rotate stably.

Figure 3C:
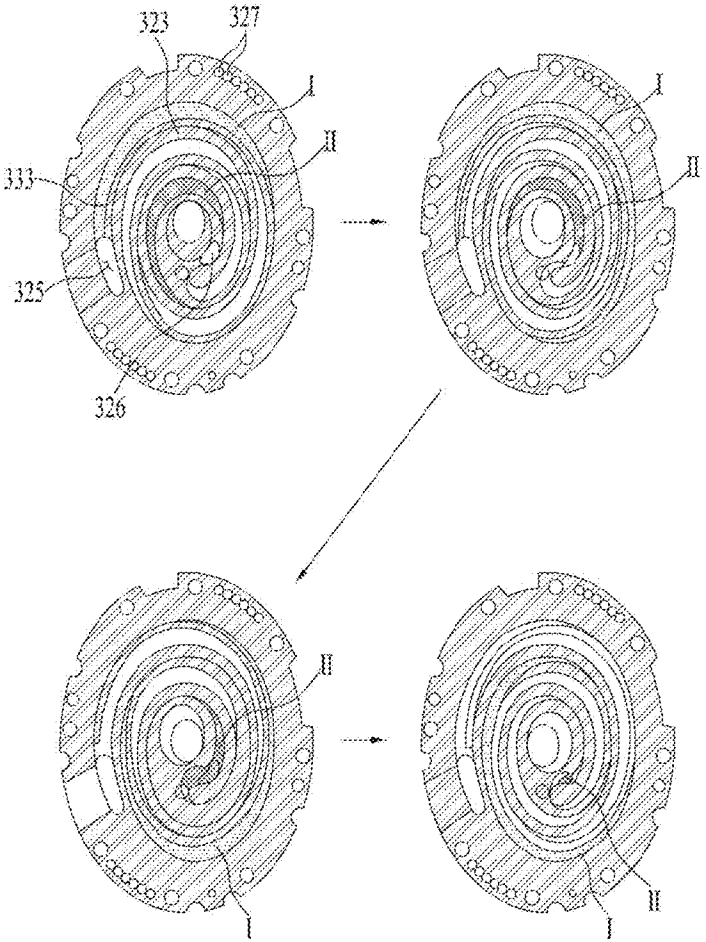
FIGS. 3A to 3C illustrate a method of operation of the compressor according to one embodiment of the present disclosure.
Figure 3A:
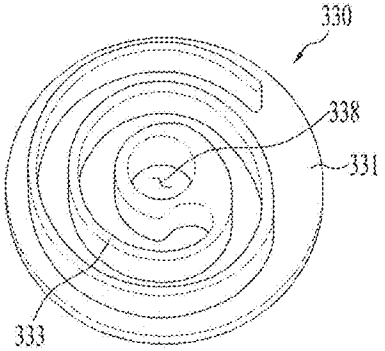
Figure 3B:
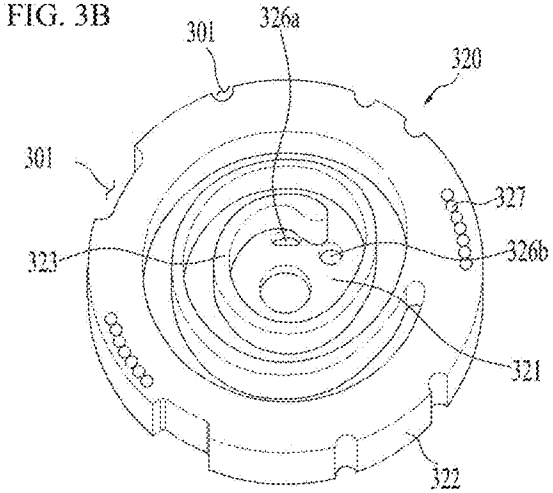

FIGS. 3A to 3C illustrate a process in which the compressor of the present disclosure compresses the refrigerant.

FIG. 3A illustrates the orbiting scroll, FIG. 3B illustrates the fixed scroll, and FIG. 3C illustrates a process in which the orbiting scroll and the fixed scroll type compress the refrigerant.

The orbiting scroll 330 may include the orbiting wrap 333 on one face of the orbiting end plate 331, and the fixed scroll 320 may include the fixed wrap 323 on one face of the fixed end plate 321.

In addition, the orbiting scroll 330 is provided as a sealed rigid body to prevent the refrigerant from being discharged to the outside, but the fixed scroll 320 may include the inflow hole 325 in communication with a refrigerant supply pipe such that the refrigerant in a liquid phase of a low temperature and a low pressure may inflow, and the discharge hole 326 (collectively including 326*a* and 326*b*) through which the refrigerant of a high temperature and a high pressure is discharged. Further, the bypass hole 327 through which the refrigerant discharged from the discharge hole 326 is discharged may be defined in an outer circumferential face of the fixed scroll 320.

In one example, the fixed wrap 323 and the orbiting wrap 333 may be formed in an involute shape and at least two contact points between the fixed wrap 323 and the orbiting wrap 333 may be formed, thereby defining the compression chamber.

The involute shape refers to a curve corresponding to a trajectory of an end of a yarn when unwinding the yarn wound around a base circle having an arbitrary radius as shown.

However, in the present disclosure, the fixed wrap 323 and the orbiting wrap 333 are formed by combining 20 or more arcs, and radii of curvature of the fixed wrap 323 and the orbiting wrap 333 may vary from part to part.

That is, the compressor of the present disclosure is disposed such that the rotation shaft 230 penetrates the fixed scroll 320 and the orbiting scroll 330, and thus the radii of curvature of the fixed wrap 323 and the orbiting wrap 333 and the compression space are reduced.

Thus, in order to compensate for this, in the compressor of the present disclosure, radii of curvature of the fixed wrap 323 and the orbiting wrap 333 immediately before the discharge may be smaller than that of the penetrated shaft receiving portion of the rotation shaft such that the space to which the refrigerant is discharged may be reduced and a compression ratio may be improved.

That is, the fixed wrap 323 and the orbiting wrap 333 may be more severely bent in the vicinity of the discharge hole 326, and may be more bent toward the inflow hole 325, so that the radii of curvature of the fixed wrap 323 and the orbiting wrap 333 may vary point to point in correspondence with the bent portions.

Referring to FIG. 3C, refrigerant I is flowed into the inflow hole 325 of the fixed scroll 320, and refrigerant II flowed before the refrigerant I is located near the discharge hole 326 of the fixed scroll 320.

In this case, the refrigerant I is present in a region at outer circumferential faces of the fixed wrap 323 and the orbiting wrap 333 where the fixed wrap 323 and the orbiting wrap 333 are engaged with each other, and the refrigerant II is enclosed in another region in which the two contact points between the fixed wrap 323 and the orbiting wrap 333 exist.

Thereafter, when the orbiting scroll 330 starts to orbit, as the region in which the two contact points between the fixed wrap 323 and the orbiting wrap 333 exist is moved based on a position change of the orbiting wrap 333 along an extension direction of the orbiting wrap 333, a volume of the region begins to be reduced, and the refrigerant I starts to flow and be compressed. The refrigerant II starts to be further reduced in volume, be compressed, and guided to the discharge hole 326.

The refrigerant II is discharged from the discharge hole 326, and the refrigerant I flows as the region in which the two contact points between the fixed wrap 323 and the orbiting wrap 333 exist moves in a clockwise direction, and the volume of the refrigerant I decreases and starts to be compressed more.

As the region in which the two contact points between the fixed wrap 323 and the orbiting wrap 333 exist moves again in the clockwise direction to be closer to an interior of the fixed scroll, the volume of the refrigerant I further decreases and the refrigerant II is almost discharged.

As such, as the orbiting scroll 330 orbits, the refrigerant may be compressed linearly or continuously while flowing into the fixed scroll.

Although the drawing shows that the refrigerant flows into the inflow hole 325 discontinuously, this is for illustrative purposes only, and the refrigerant may be supplied continuously. Further, the refrigerant may be accommodated and compressed in each region where the two contact points between the fixed wrap 323 and the orbiting wrap 333 exist.

Figure 4:
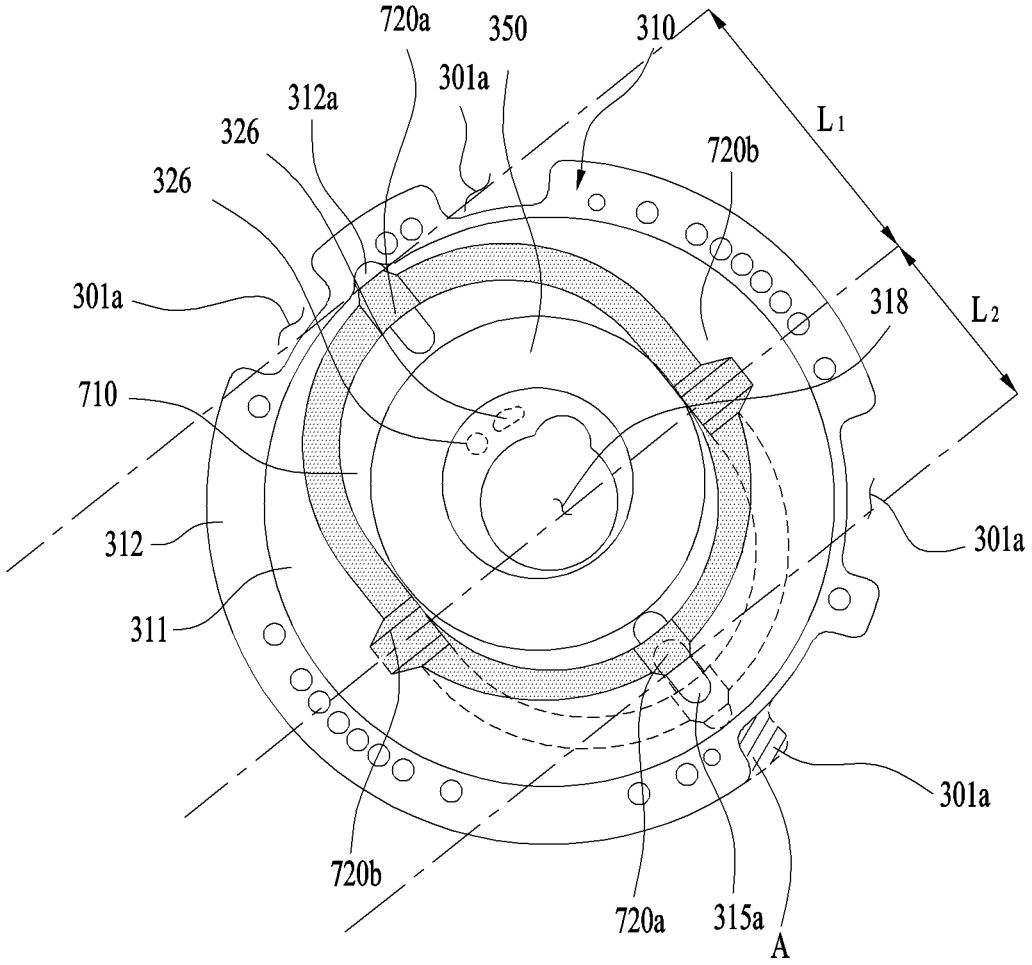
FIG. 4 illustrates an Oldham's ring of a compressor according to one embodiment of the present disclosure.

FIG. 4 illustrates a structure of an Oldham's ring of a compressor according to an embodiment of the present disclosure.

Referring to FIG. 4, the Oldham's ring of the compressor according to the present disclosure includes a ring body 710 provided between the orbiting scroll 330 and the main frame 310, and a plurality of keys 720 protruding from the ring body and coupled to the orbiting scroll and the main frame. The ring body 710 may be seated on the main side plate 312 of the main frame and may be constructed in a circle or ellipse shape or a track shape to accommodate the backpressure seal 350 therein.

The plurality of keys 720 may include a frame key 720*a* protruding from one face of the ring body and coupled to the main frame, and a scroll key 720*b* protruding from the other face of the ring body and coupled to the orbiting scroll.

The plurality of keys 720 may be constructed to protrude from positions of the ring body corresponding to a radial direction of the ring body or the minor axis and major axis directions, respectively. For example, the frame key 720*a* may be constructed to protrude from a portion corresponding to the major axis of the ring body 710 in the same direction as the major axis direction. The scroll key 720*b* may be constructed to protrude from a position corresponding to the minor axis of the ring body 710 in a direction opposite to the direction in which the frame key 720*a* protrudes.

An extension line of a line between the plurality of frame keys 720*a* and an extension line of a line between the plurality of scroll keys 720*b* may be perpendicular to each other. The plurality of frame keys 720*a* may be arranged in a parallel line to a line extending from the center of the main shaft receiving portion 318 to the center of the backpressure seal 350.

The backpressure seal 350 may be constructed to receive an oil or refrigerant therein to generate a back pressure for pushing the orbiting scroll 330 to the fixed scroll 320. In this connection, the discharge hole 326 of the fixed scroll 320 may be spaced apart from the rotation shaft 230 because the rotation shaft 230 passes through the fixed scroll 320. That is, the discharge hole 326 is defined in the fixed main plate 311 and is spaced apart from the fixed shaft receiving portion 318. Since the refrigerant is discharged from the discharge hole 326, a strong reaction force may be generated in a radial direction of the discharge hole 326. Accordingly, a center of the backpressure seal 350 may be positioned in the discharge hole 326 such that the backpressure seal 350 may press the orbiting scroll 330 toward the discharge hole 326 to prevent the orbiting scroll 330 from vibrating.

The Oldham's ring 700 according to the present disclosure may be oriented such that the major axis of the ring body 710 lies in a direction in which the backpressure seal 350 is eccentric. Therefore, the Oldham's ring 700 may easily reciprocate inside the main frame 310 while receiving the eccentric backpressure seal 350.

The main frame 310 may include a plurality of main key grooves 315 defined in the main end plate, into which the frame key 720*a* is inserted, respectively. The main key grooves 315 may be arranged in a radial direction of the main shaft receiving portion 318 or may be arranged in a parallel manner and around the main shaft receiving portion 318. The main key groove 315 may have a length such that the frame key 720 is inserted therein to reciprocate in the radial direction of the main end plate 311.

The main end plate 311 may have a circular inner circumferential face. However, in one side of the main end plate 311, a collision-prevention groove 312*a* may be defined to receive one end of the main key groove 315 or to prevent collision thereof with the scroll key 720. The collision-prevention groove 312*a* may be recessed in the inner circumferential face of the main side plate 312 outwardly.

In one example, the Oldham's ring 700 according to the present disclosure may have an asymmetrical structure with respect to the radial direction, the major axis direction, or the minor axis direction. For example, the Oldham's ring 700 may have an asymmetrical structure with respect to the minor axis direction. The ring body 710 may have an asymmetrical structure with respect to a line extending between the plurality of scroll keys 720*b*. A shortest distance L1 of one of the plurality of frame keys 720*a* and the line extending between the plurality of scroll keys 720*b* may be not equal to a shortest distance L2 of another of the plurality of frame keys 720*a* and the line extending between the plurality of scroll keys 720*b*. The frame key 720*a* spaced apart from the line extending between the plurality of scroll keys 720*b* at a larger spacing among the plurality of frame key 720*a* may be closer to the center of the backpressure seal 350.

Hereinafter, the center of the backpressure seal 350 may be defined as a center of an outer circumferential face of a total area in which the backpressure seal 350 moves with respect to the main frame.

The Oldham's ring 700 may be asymmetrically constructed such that the frame key 720*a* spaced apart from the line extending between the plurality of scroll keys 720*b* at a larger spacing among the plurality of frame key 720*a* may be closer to the discharge hole 327. That is, the ring body 710 may be asymmetrically constructed such that only one frame key 720*a* of the plurality of frame key 720*a* may be closer to the discharge hole 327 than other frame keys may be.

Thus, one frame key 720*a* of the plurality of frame keys 720*a* may be spaced apart from the main side plate 311 at a larger spacing. One of the main key grooves 315 may be defined in the main side plate 311 and may be spaced, at a larger spacing, from the main shaft receiving portion 318. The frame key 720*a* which is spaced apart from the backpressure seal 350 at the larger spacing may be prevented from collision with the main side plate 311. As a result, the main frame 310 may be free of the collision-prevention groove 312*a* and thus maintain the inner circumferential surface of the main side plate 312 to be continuously circular. Therefore, the pressure is prevented from being generated non-uniformly in the main frame 310 to increase the efficiency of the compressor and to reduce vibration and noise.

Further, since the collision-prevention groove 312*a* is removed, an area of the main collection channel 301*a* defined as a D-CUT in the outer circumferential face of the main side plate 312 may be extended by an area A. Thus, a total cross-sectional area of the oil collection channel of the compressor may be increased, thereby to increase the oil collection ability. The area A may correspond to an area required to space the collection channel 301*a* from the groove 312*a* when the groove 312*a* is installed in the main frame 310.

Therefore, the collection channel 301*a* may be disposed to overlap at least one of the plurality of main key grooves 315 in the radial direction of the rotation shaft. In other words, at least one of the plurality of main key grooves 315 may overlap the collection channel 301*a* in the radial direction.

In the compressor 10 according to the present disclosure, the ring body 710 is asymmetrically constructed, and the frame keys 720*a* are arranged asymmetrically. Thus, the main key grooves 315 may be arranged in an asymmetrical manner with respect to the main shaft receiving portion 318. The plurality of main key grooves 315 may be arranged asymmetrically around the rotation shaft 230.

Although not shown, the orbiting scroll 330 may include a plurality of orbiting key grooves 335 defined in the orbiting end plate 331, into which the scroll keys 720*b* are inserted, respectively.

Figure 5A:
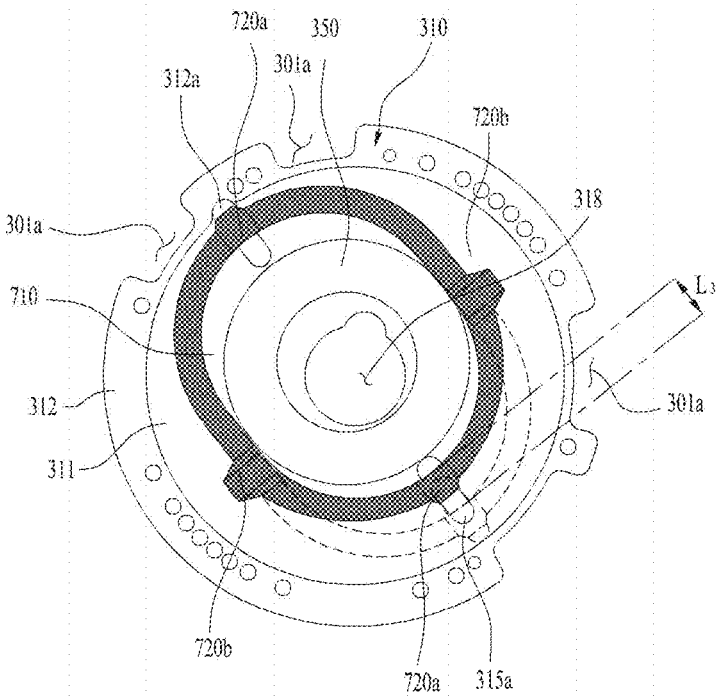
FIGS. 5A and 5B illustrate an Oldham's ring of a compressor according to another embodiment of the present disclosure.
Figure 5B:
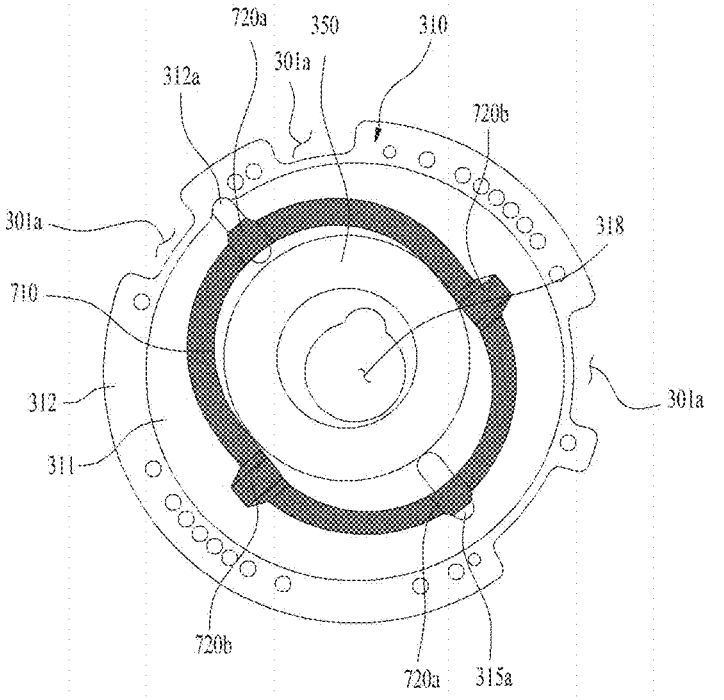

FIGS. 5A and 5B illustrate an Oldham's ring of a compressor according to one embodiment of the present disclosure.

Referring to FIG. 5A, the Oldham's ring 700 may be constructed to be shortened so that one end spaced farthest from the backpressure seal 350 is closer towards the eccentric backpressure seal.

The ring body 710 may be constructed to be shortened such that one of the plurality of frame keys 720*a* is closer to another frame key toward the eccentric backpressure seal 350. The ring body 710 may be constructed to be shortened such that one of the plurality of frame key 720*a* spaced from the center of the backpressure at a larger spacing is further closer to the frame key 720*a* spaced from the center of the backpressure seal at a smaller spacing.

The ring body 710 may be constructed to be shortened such that one of the plurality of frame key 720*a* spaced from the center of the backpressure at a larger spacing is further closer, by a distance L3 between the center of the backpressure seal and the center of the rotation shaft, to the frame key 720*a* spaced from the center of the backpressure seal at a smaller spacing.

In other words, the ring body 710 is constructed to be shortened compared to a construction in which the ring body 710 is symmetrically constructed about the minor axis. In this connection, a maximum length by which one end of the ring body 710 to be reduced or the frame key 720*a* may be reduced may be the distance L3 between the center of the backpressure seal and the center of the rotation shaft. That is, the ring body 710 may be constructed to be shortened such that one end of the major axis thereof is reduced toward the eccentric backpressure seal 350. One end of the major axis thereof may be constructed to be shortened by the distance L3 between the center of the backpressure seal and the center of the rotation shaft.

An area occupied by the ring body 710 when the ring body 710 is constructed asymmetrically may be reduced compared to the area thereof when the ring body 710 is constructed symmetrically. As a result, the weight of the ring body 710 may be reduced. Since the ring body 710 is mounted on the orbiting scroll 330 and acts as a load on the driver 200, the efficiency of the compressor may be further increased due to the weight reduction of the ring body 710. When the ring body 710 has one end shortened by the length of L3 while the other end thereof is not shortened, the weight of the ring body 710 may be greatly reduced.

In one example, the ring body is constructed such that the minor axis thereof is orthogonal to the major axis thereof. Both ends of the minor axis are constructed to be shortened to a diameter of the backpressure seal or to the outer circumferential face of a total area in which the backpressure seal 350 moves. That is, a distance between a plurality of the scroll keys 720*a* may be defined in a corresponding manner to an area within which the backpressure seal 350 may move. As a result, the length of the minor axis of the ring body 710 may be minimized, thereby reducing the area occupied by the Oldham's ring and the weight thereof to the maximum degree.

In other words, the Oldham's ring 700 may be constructed such that one end thereof spaced farthest from the backpressure seal 350 is closer toward the minor axis than the other end is. The Oldham's ring 700 includes the ring body 710 having, as the major axis thereof, an extension line of a line between the center of the backpressure seal 350 and the center of the rotation shaft 230 between the orbiting scroll and the main frame. The ring body 710 may be constructed such that one end of the major axis thereof spaced furthest from the eccentric backpressure seal 350 is closer to the minor axis and toward the eccentric backpressure seal than the other end is. One end of the major axis thereof may be closer to the minor axis than the other end is by the distance L3 between the center of the rotation shaft and the center of the backpressure seal.

One of the plurality of frame key 720*a* may be constructed to be closer to the backpressure seal than another frame key is. In other words, the frame key constructed to be spaced from the center 350*a* of the backpressure seal at a larger spacing among the plurality of frame keys 720*a* may be constructed to be closer to the minor axis such that the frame key is further closer to a frame key constructed to be spaced from the center 350*a* of the backpressure seal at a smaller spacing. A distance by which one of the plurality of frame keys 720*a* is further closer to the minor axis may correspond to the distance L3 between the center 350*a* of the backpressure seal and the center 230*a* of the rotation shaft.

A distance between both ends of the minor axis of the ring body 710 may correspond to a diameter of an outer circumferential face of a space in which the backpressure seal 350 moves.

Referring to FIG. 5B, the ring body 710 may move inside the main frame 310 based on a direction of the main key groove 315 according to the movement of the orbiting scroll 330. In this connection, the key groove 315*a* corresponding to the frame key 720*a* disposed on the shortened portion of the ring body 710 among the main key grooves may be further spaced apart from the main side plate 312.

The key groove 315*a* may be constructed such that one end thereof contacts an outer circumferential face of an area in which the backpressure seal 350 moves. Accordingly, even when the collision-prevention groove 312*a* is omitted from the main frame 310, collision between the frame key 720*a* and the main side plate 312 may be prevented. Further, the area of the main channel 301*a* may be increased as much as possible.

Hereinafter, another embodiment of a compressor according to the present disclosure will be described with reference to FIG. 6.

Figure 6:
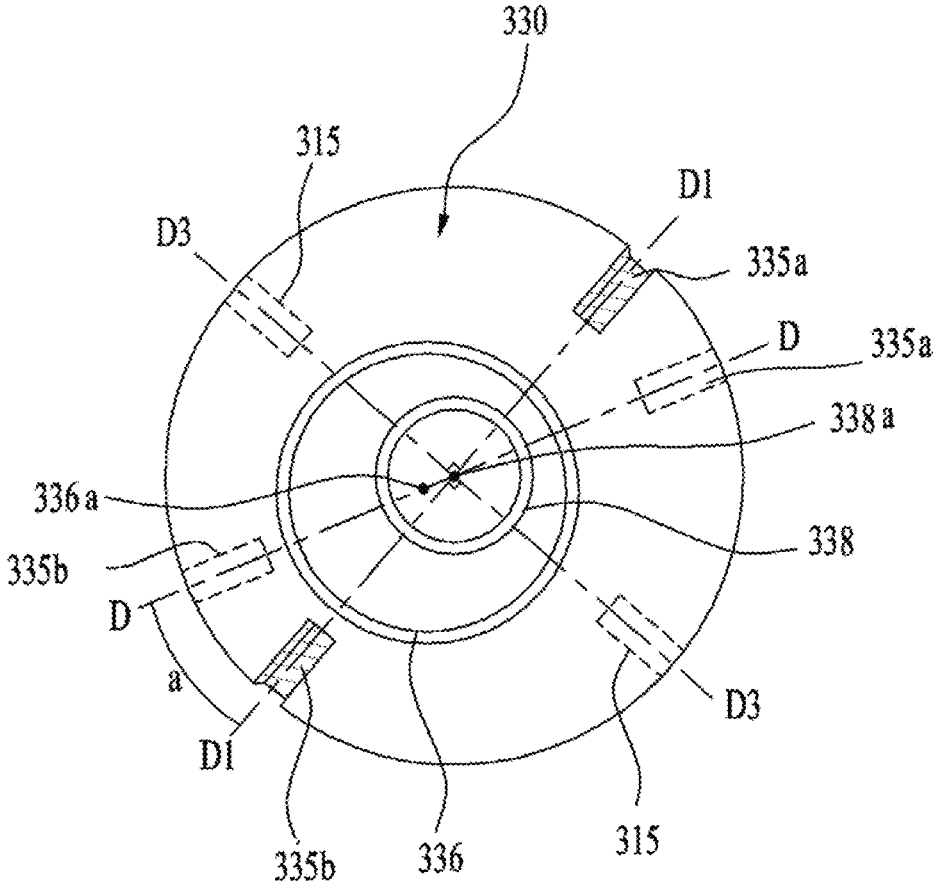
FIG. 6 illustrates an Oldham's ring in accordance with another embodiment of the present disclosure.

FIG. 6 illustrates an orbiting scroll of a compressor according to the present disclosure.

The orbiting scroll 330 according to the present disclosure may include an orbiting shaft receiving portion 338 through which the rotation shaft 230 passes and a sealing groove 336 on which the back pressure seal 350 is seated.

In the compressor according to one embodiment of the present disclosure as shown in FIGS. 5A and 5B, the main key grooves 315 are arranged on an extension line D between a center 336*a* of the sealing groove 336 and a center 338*a* of the orbiting shaft receiving portion 338. Orbiting key grooves 335 in which the scroll key 720*b* is inserted may be arranged in a line perpendicular to the line D.

However, the compressor according to another embodiment of the present disclosure shown in FIG. 6, the extension line D1 between the plurality of main key grooves 315*a* may be spaced, by an angular spacing "a", the extension line D between the center 336*a* of the sealing groove 336 and the center 338*a* of the orbiting shaft receiving portion 338 on which the main key grooves 315 are arranged.

The ring body 710 may be constructed such that the major axis line D1 thereof is spaced, by an angular spacing "a", from the extension line D between the center 336*a* of the sealing groove 336 and the center 338*a* of the orbiting shaft receiving portion 338. Thus, a plurality of frame key 720*a* may be arranged in a line misaligned with the eccentric portion of the backpressure seal 350. In other words, the plurality of frame key 720*a* may be arranged in a line spaced by a certain angular spacing from the extension line D between the center of the backpressure seal and the center of the main shaft receiving portion 318.

Thus, the orbiting scroll 330 may be constructed to reciprocate in the main frame 310 in a direction different from the direction D in which the backpressure seal 350 is eccentric. Further, the major axis and the minor axis of the ring body 710 may not correspond to the direction D in the main frame 310 in which the backpressure seal 350 is eccentric.

Figure 7:
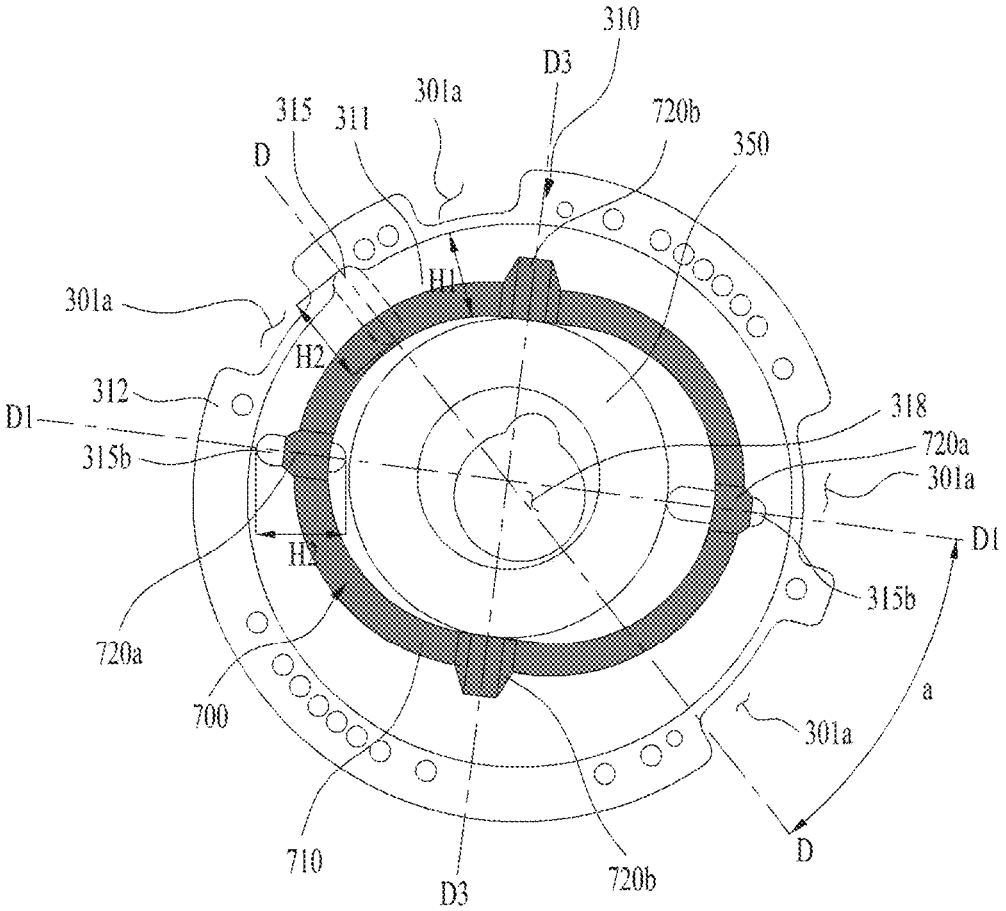
FIG. 7 illustrates an embodiment of a main scroll according to FIG. 6.

FIG. 7 illustrates a main frame to which the Oldham's ring structure of FIG. 6 is applied.

Referring to FIG. 7, the Oldham's ring 700 may be disposed in the main frame 310 and may have an asymmetrical structure with respect to an extension line D between the center of the backpressure seal 350 and the center of the main shaft receiving portion 318. In other words, the major axis D1 of the ring body 710 may be spaced by a certain angular spacing, from the extension line D.

The backpressure seal 350 is eccentrical around the main shaft receiving portion 318 and is biased toward the main side plate 312. Thus, the shortest distance H1 between the main side plate 312 and the outer circumferential face defined by the area in which the backpressure seal 350 moves in the main end plate 311 may be smaller than another distance between the main side plate 312 and the outer circumferential face defined by the area in which the backpressure seal 350 moves. Further, the shortest distance H1 may be smaller than a length H2 of the main key groove 315. Therefore, when the main key groove 315 is installed at a portion of the main frame corresponding to the shortest distance H1, the collision-prevention groove 312*a* should be defined in the main frame.

However, in the compressor according to the present disclosure, the Oldham's ring 700 may be constructed such that the major axis D1 of the ring body 710 may be inclined with respect to the extension line D. In this connection, the major axis D1 of the ring body 710 is positioned at a position such that a distance between the outer circumferential face defined by the area in which the backpressure seal 350 moves and the main side plate 312 is greater than or equal to the length H2 of the main key groove 315. A position defined such that the distance between the outer circumferential face defined by the area in which the backpressure seal 350 moves and the main side plate 312 is equal to the length H2 of the main key groove 315 is spaced, by an angular spacing "a" angle, from the extension line D around the rotation shaft 230. Accordingly, the major axis D1 of the ring body 710 may be spaced, by an angular spacing greater than or equal to the angle "a" from the extension line D.

Thus, the main key groove 315 may not be installed at a portion corresponding to the shortest distance H1. In the compressor according to the present disclosure, a new main key groove 315*b* may be defined at a point where a length of the inner circumferential face of the main side plate 312 and a length of the outer circumferential face defined by the area in which the backpressure seal 350 moves is equal to or greater than H2. The other main key grooves 315*b* may be arranged in a parallel line to the longitudinal direction of the main key groove 315*b*.

In other words, in the main frame 310 of the compressor according to the present disclosure, an installation position of the main key groove 315*b* may be changed such that an extension line of a line between the main key grooves 315*b* may be spaced, by an angular spacing greater than or equal to the angle "a" from the extension line of a line between the center of the backpressure seal 350 and the center of the main shaft receiving portion 318.

As such, the Oldham's ring 700 according to the present disclosure may be constructed such that the plurality of frame keys 720 are arranged in a line inclined relative to the extension line D between the center of the backpressure seal 350 and the center of the rotation shaft 230. As a result, the main key groove 315*b* may be installed in the main end plate 311 without being affected by the backpressure seal 350, and thus the entire inner circumferential surface of the main side plate 312 may define a continuous surface. That is, the entire inner circumferential surface of the main side plate 312 may be constructed to form a complete continuous circle. As a result, the collision-prevention groove 312*a* may not be defined in the inner circumferential surface of the main side plate 312. Therefore, a symmetrical pressure gradient is created in the main frame 310 and around the main shaft receiving portion 318 to improve compression efficiency and reduce vibration and noise.

Effects as not described herein may be derived from the above configurations. The relationship between the above-described components may allow a new effect not seen in the conventional approach to be derived.

In addition, embodiments shown in the drawings may be modified and implemented in other forms. The modifications should be regarded as falling within a scope of the present disclosure when the modifications is carried out so as to include a component claimed in the claims or within a scope of an equivalent thereto.

What is claimed is:

1. A compressor comprising:

a casing;

a driver coupled to inner surface of the casing and configured to rotate a rotation shaft; and a compression assembly engaged with the rotation shaft and configured to compress a refrigerant, wherein the compression assembly includes:

a fixed scroll coupled to inner surface of the casing;

an orbiting scroll connected to the rotation shaft and configured to orbit relative to the fixed scroll, a main frame connected to the fixed scroll and at least partially receiving the orbiting scroll, the main frame supporting the rotation shaft;

a ring engaged with the orbiting scroll and the main frame to block spinning of the orbiting scroll; and a backpressure seal seated on the orbiting scroll within the ring, wherein the fixed scroll comprises:

a fixed end plate coupled to an inner surface of the casing and facing the main frame, and a discharge hole extending through the fixed end plate to discharge the refrigerant, the discharge hole being spaced apart from the rotation shaft in a first direction, wherein the discharge hole is offset from the center of the fixed end plate toward the inner surface of the casing, wherein the back pressure seal is offset from the rotation shaft in the first direction, and wherein the ring is offset from the rotation shaft in the first direction on the mainframe.

2. The compressor of claim 1, wherein the ring includes:

a ring body disposed between the orbiting scroll and the main frame, wherein the rotation shaft extends through the ring body;

a plurality of scroll keys protruding from the ring body and inserted into the orbiting scroll; and a plurality of frame keys protruding from the ring body and inserted into the main frame, wherein the ring body is provided asymmetrically with respect to a direction in which the plurality of scroll keys extend or a direction in which the plurality of frame keys extend.

3. The compressor of claim 2, wherein the ring body is asymmetrical such that a distance between one of the plurality of scroll keys and one of the plurality of frame keys is different from a distance between the one of the plurality of scroll keys and another frame key of the plurality of frame keys.

4. The compressor of claim 2, wherein the ring body is asymmetrical such that a shortest distance between one of the plurality of frame keys and a line extending through the plurality of scroll keys is different from a shortest distance between another of the plurality of frame keys and the line extending through the plurality of scroll keys.

5. The compressor of claim 1, wherein the main frame comprises a main shaft receiving portion receiving the rotating shaft, and wherein the ring body is asymmetrical such that one of the plurality of frame keys spaced from a line extending through the plurality of scroll keys by a larger spacing than the other frame keys is closer to a center of the backpressure seal.

6. The compressor of claim 1, wherein the backpressure seal is configured to apply a back pressure toward the discharge hole, wherein of both ends corresponding to the long axis of the ring, one end of the ring spaced apart from the back pressure seal is provided closer to the minor axis of the ring than the other end of the ring.

7. The compressor of claim 6, wherein the ring includes a ring body having a major axis and a minor axis, wherein the major axis is a line extending between a center of the backpressure seal and a center of the rotation shaft, wherein an end of the major axis of the ring body that is spaced farther from the eccentric backpressure seal than an opposite end of the major axis of the ring body is closer to the minor axis than the opposite end of the major axis of the ring body.

8. The compressor of claim 7, wherein the end of the major axis of the ring body is provided closer to the minor axis of the ring body than the opposite end of the major axis of the ring body, wherein the closer distance corresponds to a distance from which the center of the backpressure seal is spaced apart from the center of the rotation shaft.

9. The compressor of claim 7, wherein the ring includes a plurality of frame keys protruding from the ring body in a direction along the major axis and inserted into the main frame, wherein the ring body is constructed such that one of the plurality of frame keys is closer to the backpressure seal than another of the plurality of frame keys.

10. The compressor of claim 9, wherein the plurality of frame keys includes a first frame key and a second frame key, the first frame key being spaced farther from the center of the backpressure seal than the second frame key, and wherein the ring body is constructed such that a first distance between the first frame key and the minor axis is shorter than a second distance between the second frame key and the minor axis, thereby reducing a distance between the first frame key and the second frame key.

11. The compressor of claim 10, wherein a length by which the first distance is shorter than the second distance is equal to a distance between the center of the backpressure seal and the center of the rotation shaft.

12. The compressor of claim 7, wherein the minor axis is perpendicular to the major axis, and wherein a distance between opposite ends in the minor axis of the ring body is equal to a diameter of the backpressure seal.

13. The compressor of claim 6, wherein the ring is an Oldham's ring.

14. The compressor of claim 1, wherein the main frame includes:

a main end plate through which the rotation shaft extends, a main side plate extending along a circumference of the main end plate and configured to receive the ring body, and a plurality of main key grooves defined in the main end plate, wherein the plurality of frame keys of the ring are inserted into, and movable linearly along, the plurality of main key grooves, respectively, wherein the plurality of main key grooves are arranged asymmetrically about the rotation shaft.

15. The compressor of claim 14, wherein the main frame further includes a collection channel configured to receive an oil, wherein the channel is recessed at a face of the main side plate, wherein at least one of the plurality of main key grooves overlaps the collection channel in a radial direction of the rotation shaft.

16. The compressor of claim 14, wherein at least one of the plurality of main key grooves is spaced apart from a peripheral surface of the main side plate toward the rotation shaft by a larger distance than another of the plurality of main key grooves.

17. The compressor of claim 14, wherein the ring is an Oldham's ring.

18. The compressor of claim 1, wherein the plurality of frame keys are arranged to be inclined relative to a line extending between a center of the backpressure seal and a center of the rotation shaft.

19. The compressor of claim 18, wherein the main frame includes:

a main end plate through which the rotation shaft extends;

a main side plate extending along a circumference of the main end plate and configured to receive the ring body; and a plurality of main key grooves defined in the main end plate, wherein the plurality of frame keys of the ring are inserted into, and movable linearly along, the main key grooves respectively, wherein the main side plate has a circular shape configured to prevent the plurality of frame keys from colliding with the main side plate so that the main side plate is free of a collision-prevention groove.

20. The compressor of claim 18, wherein the ring is an Oldham's ring.

21. The compressor of claim 1, wherein the ring is an Oldham's ring.

* * * * *